United States Patent [19]

Peterson et al.

[11] 4,446,702

[45] May 8, 1984

[54] MULTIPORT CRYOPUMP

[75] Inventors: John F. Peterson, Lynnfield; Allen J. Bartlett, Milford, both of Mass.

[73] Assignee: Helix Technology Corporation, Waltham, Mass.

[21] Appl. No.: 466,122

[22] Filed: Feb. 14, 1983

[51] Int. Cl.[3] ..... B01D 8/00

[52] U.S. Cl. ..... 62/55.5; 55/269; 62/100; 62/268; 417/901

[58] Field of Search ..... 62/55.5, 100, 268; 417/901; 55/269

[56] References Cited

U.S. PATENT DOCUMENTS 4,148,196 4/1979 French et al. .
4,339,927 7/1982 Sarcia .

OTHER PUBLICATIONS

Schematic of a Multiport Cryopump, Author unknown, Helix Technology Corporation Files, Circa 1979.
Detailed drawing of the Multiport Cryopump of Reference AR, Author unknown, Helix Technology Corporation Files, Circa 1979.

*Primary Examiner*—Ronald C. Capossela
*Attorney, Agent, or Firm*—Hamilton, Brook, Smith & Reynolds

[57] ABSTRACT

A cryopump installation in which a novel cryopump 20 maintains a work chamber 12 at continuous high vacuum while periodically evacuating a load lock 14 in order to allow transfer of material from the load lock 14 to the work chamber 12 without disruption of the work chamber environment. The cryopump has pumping ports 46 positioned on the radiation shield 50 in order to pump plenum 72 to a high vacuum. Load lock gases enter the cryopump through port 46 and are condensed and adsorbed by the radiation shield 50 and second stage cryopanel 54.

11 Claims, 4 Drawing Figures

MULTIPORT CRYOPUMP

DESCRIPTION

1. Technical Field

This invention relates to cryopumps, specifically to cryopumps used in applications where a work chamber must be continuously maintained at high vacuum during manufacturing operations.

2. Background

Cryopumps are frequently used to remove gases from work environments and subsequently hold the environments at high vacuum. Many processes require near perfect vacuum environments to obtain good results. In many instances, best process results and manufacturing efficiency are achieved where vacuum is continuously maintained in the work space. In this way, uniform and repeatable processes may be performed without interruption.

Working environment pressures below $5\times10^{-7}$ torr are typically achieved with cryopumps but have been difficult to achieve during repetitive manufacturing processes. In most operations it is necessary to transfer materials into and out of the high vacuum working space. Conventionally, work material is moved into the high vacuum space by exposing the space to atmospheric conditions. This space is then evacuated to high vacuum conditions in order to conduct the manufacturing process. This period of evacuation is often lengthy and does not always result in the optimum conditions being achieved in the work space. An alternative to this approach is to utilize a vacuum load lock to move the material in and out of the work space. Material is placed in the load lock and this space is evacuated to an intermediate pressure by a secondary pumping means. The main work space is maintained at high vacuum by the primary pumping system. This load lock space is then exposed to the main work space and a significant amount of contamination is transferred to the main work space. This amount of contamination can be reduced by reducing the pressure achieved in the load lock. In the past, an alternate high vacuum pump was required to achieve low pressures in the load lock. An object of this invention is to provide the alternate high vacuum pumping with a second port on a given cryopump Thus, both the pumping of the main work space and the load lock can be accomplished with a single pump.

Crossover chamber pressure is typically limited to a rough vacuum by the limitations of the roughing pumps used to depressurize crossover chambers Roughing pumps should be limited to minimum pressures in the range of 400 millitorr to minimize the effect of oil backstreaming. Typically pump pressure above 400 millitorr keeps gas flow in the viscous range. At lower pressure, oil vapor is released from the roughing pump, and enters the work chamber by molecular backstreaming. Essentially, if the pressure is too low, oil vapor from the roughing pump mixes with residual gas in the crossover area. The residual gas (which typically consists of a majority of water vapor with lesser amounts of atmospheric gases and possibly oil vapor) in the crossover area is released into the working space when matter is transferred from the crossover area into the work space and thus contaminates the workspace. Presence of any contaminant in the work space causes degradation of the many processes which are best conducted in high vacuums.

Since the load lock must be maintained at the relatively high crossover pressure determined by the roughing pump,a relatively large pulse of gas is injected into the work space when material is released from the load lock. This pulse must be handled by the condensing arrays of the cryopump which maintains the high vacuum environment of the work space.

Process timing is therefore affected by the need to wait until the gas pulse injected into the working space from the load lock is removed by the cryopump. In many cases, work space pressure is increased to a level far too high for the affected manufacturing process to continue. Work must therefore cease periodically during the pumping of the crossover gas from the work chamber. Valuable work time is thereby lost as technicians wait for the work space to stabilize at a low pressure every time material is transferred.

In the past a second cryopump or a cryopump modified to create two pumping ports has been used to reduce the crossover pressure and minimize the gas pulse during the transfer of material. An arrangement requiring an additional cryopump is considerably more expensive than conventional systems. Arrangements with cryopumps having second pumping ports utilize extensively modified cryopumps that isolate and seal a second pumping port from the primary pumping port so that crossover gas is not inadvertently transferred through the cryopump to the work space. This expensive sealing of two separate ports has a disadvantage in that the ports must be perfectly matched for the use intended. Otherwise, if the division within the cryopump does not correctly reflect the percentage of gas pumped separately from the crossover chamber and the work space, the capacity for gas which can be condensed by the cryopump may be reached prematurely, and cryopump regeneration will be frequently required. Cryopump regeneration results in additional loss of work time and manufactured product since system shutdown is required.

A need therefore exists to minimize the amount of gas injected into the work space by inexpensively achieving lower crossover pressures than previously possible without risk of work space contamination from the load lock.

DISCLOSURE OF THE INVENTION

A cryopump system comprising this invention includes a work chamber in which material is processed, a load lock for receiving material to be introduced into the work chamber and a cryogenic refrigerator in fluid communication by fluid conduits with both the work chamber and load lock. The cryogenic refrigerator comprises two refrigerator stages in which a second stage cryopumping surface is in contact with the second stage of the refrigerator. A radiation shield in thermal contact with the first stage of the refrigerator surrounds the second stage cryopumping surface. The radiation shield has a frontal opening for providing gas communication from the work chamber to the second stage cryopumping surface and a rear opening for providing gas communication from the load lock to the second stage cryopumping surface.

In the preferred embodiment, the radiation shield is in close proximity to a cryopump housing in order to form a flow restriction that prevents gas flow between either of the two radiation shield openings. Alternatively, a positive seal may be placed between the radiation shield and the cryopump housing to eliminate gas flow between the two areas. A further element of the preferred embodiment is a baffle positioned adjacent to the rear opening of the radiation shield which blocks direct radiation from affecting the second stage refrigerator.

In an alternative embodiment, an extension of the radiation shield surrounds but does not contact the fluid conduit from the load lock. The extension of the radiation shield has internal baffles which block direct radiation from impinging on the second stage. The extension serves to prevent water vapor condensation from occuring on the exterior of the radiation shield which would increase the emissivity of the radiation shield.

BRIEF DESCRIPTION OF THE DRAWINGS

The foregoing and other objects, features, and advantages of the invention will be apparent from the following more particular description of the preferred embodiments of the invention, as illustrated in the accompanying drawings in which like reference characters refer to the same parts throughout the different views. The drawings are not necessarily to scale, emphasis instead being placed upon illustrating the principles of the invention.

PREFERRED EMBODIMENTS OF THE INVENTION

Figure 1:
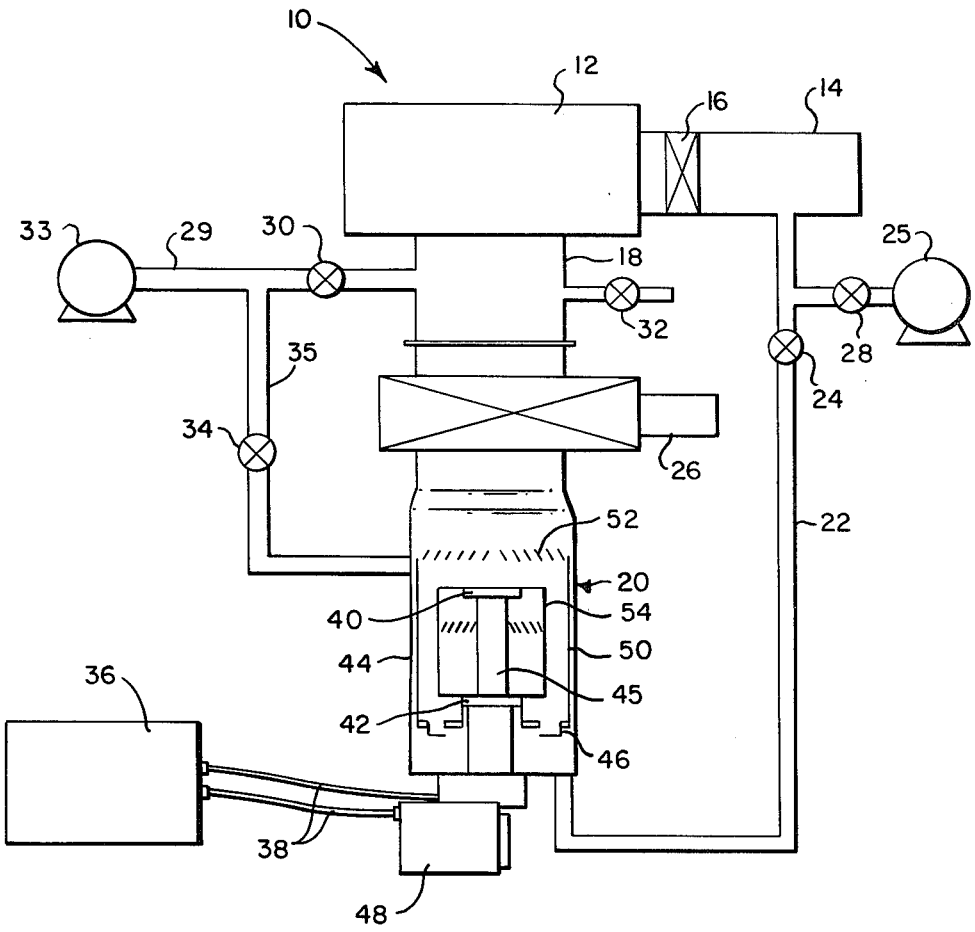
FIG. 1 is a schematic representation of a cryopump incorporating this invention, placed within a manufacturing system.

FIG. 1 illustrates a typical system which would benefit from the use of a cryopump incorporating the invention. The cryopumping installation 10 includes a work chamber 12 and load lock 14. The work chamber is maintained at a high vacuum by the cryopump 20 which is connected to the work chamber by conduit 18. The cryopump may be isolated from the working chamber by gate valve 26.

When the system is initially started, the work environment is brought to an intermediate vacuum pressure by roughing pump 33 which is connected by conduits 29 and 18 to the work chamber 12. The roughing pump also initially pumps down the cryopump 20 to a moderate vacuum through conduit 35. After the work chamber and cryopump have been evacuated to a moderate vacuum pressure, valves 30 and 34 are closed and the cryopump is activated, drawing down chamber pressure to a very high vacuum.

The cryopump is preferably cooled by a two-stage Gifford-MacMahon refrigerator. The refrigerator includes a displacer in the cold finger 45 which is driven by motor 48. Helium gas is introduced to and removed from the cold finger 45 by lines 38 from compressor 36. Helium gas entering the cold finger is expanded by the displacer and thus cooled in a manner which produces very cold temperatures.

Material is brought into and out of the work chamber through the load lock 14. The load lock is brought to high vacuum approaching that of the work chamber 12 by means of a roughing pump 25 and the cryopump 20. First, the load lock is pumped to a rough vacuum by the mechanical pump 25. When the pressure level in the load lock reaches an intermediate vacuum state above that which would allow for backstreaming of oil vapor from the roughing pump, the roughing pump is removed from the system by the closing of valve 28.

Backstreaming is a phenomenon that occurs at pressures below approximately 400 millitorr (molecular flow region) whereby oil or grease normally found in mechanical pumps evaporates and is released into a vapor state. This oil vapor can backstream into the load lock and eventually be allowed into the work chamber, thereby introducing impurities into the work space. Impurities introduced in such a manner can be detrimental to high vacuum operations such as integrated circuit manufacture.

After the load lock has been brought to a moderate crossover vacuum of about 400 millitorr and valve 28 has been closed, valve 24 is opened to allow the cryopump 20 to evacuate the load lock 14 to a high vacuum through conduit 22. By this operation, the load lock is brought to a vacuum approaching that of the work chamber 12. After a high vacuum state is achieved in the load lock, valve 16 is opened and material is transported from the load lock 14 to the work chamber 12. Since the load lock is at high vacuum, little gas is released into the work chamber and manufacturing operations can be continued without interruption.

In prior systems, where load lock pressure was held at or above 400 millitorr, a pulse of gas would enter the work chamber 12 with each opening of the valve. This pulse of gas contains a large quantity of contaminants that is transferred to the work chamber. The primary pumping system then has to remove these contaminants before the process can continue. If the process is not terminated during transfer, the end products of the process may be unacceptable due to this contamination transfer. Normally, a not insignificant amount of time would be required to remove these contaminants each time the load lock was opened.

In a system incorporating this invention, most of the gas pulse is eliminated. This reduces the transfer of impurities from the outside environment and the roughing pump into the work chamber 12. Since most of the crossover gas is eliminated in the load lock area, gaseous impurities from any source are eliminated before they enter the work chamber.

Figure 2:
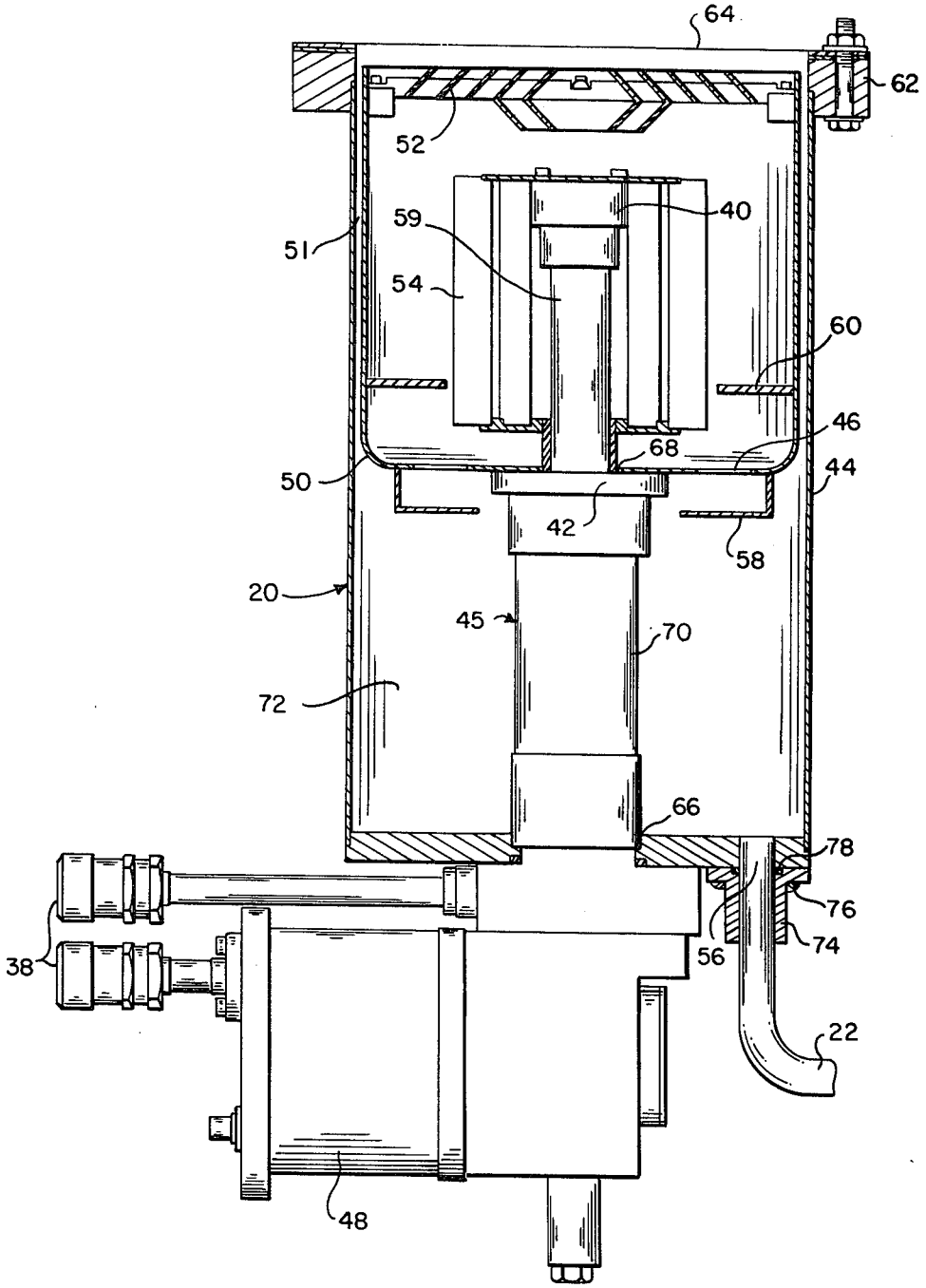
FIG. 2 is a cross section of a cryopump incorporating an embodiment of the invention.

In a conventional system, gas from the load lock 14 remaining after rough pumping has to travel through the work chamber before it is condensed at the cryopump. This allows coating or reaction of residual impurities with exposed surfaces in the work chamber. In the manufacturing system incorporating this invention, gas in the crossover chamber is eliminated through conduit 22 and never passes through the work environment. FIG. 2 is an embodiment of a cryopump capable of evacuating a space from some crossover pressure to a high vacuum while maintaining a separate vacuum chamber, or work chamber, at high vacuum. The cryopump of FIG. 2 comprises a main housing 44 which may be mounted either directly to a work chamber along flange 62 or to the gate valve 26 shown in FIG. 1. A front opening 64 in the cryopump housing 44 communicates with the work chamber through the gate valve 26. A two-stage cold finger 45 of a refrigerator protrudes into the housing through an opening 66. In this case the refrigerator is a Gifford-MacMahon, but others may be used.

A two stage displacer is arranged within the cold finger 45 and driven by motor 48. With each cycle, helium gas is introduced into the cold finger under pressure and is expanded and thus cooled. Such a refrigerator is disclosed in U.S. Pat. No. 3,218,815 to Chellis et al.

A first stage pumping surface 52 is mounted at the cold end of the heat sink 42 of the first stage refrigerator 70 through a radiation shield 50. Similarly, a second stage pumping array 54 is mounted to the cold end heat sink 40 of the second stage 70. The second stage 59 of the cold finger extends through an opening 68 at the base of the radiation shield 50.

The second stage pumping surface which is mounted to heat sink 40 operates at a temperature of about 15° Kelvin. The second stage pumping surface comprises a set of chevrons 54 arranged in a vertical array. The surfaces of the chevrons making up the pumping array may hold a low temperature adsorbent. Access to this adsorbent by low boiling point gases such as hydrogen, results in their adsorption and removal from the environment.

The cup-shaped radiation shield 50 mounted to the first stage heat sink 42, operates at about 77° Kelvin. This radiation shield 50 surrounds the lower temperature second stage cryopumping area and minimizes the heating of that area by direct radiation and higher boiling point vapors.

The front cryopanel 52 serves as both a radiation shield for the second stage pumping area and as a cryopumping surface for higher boiling temperature gases such as water vapor. This panel comprises an array of circular concentric louvers and chevrons. The configuration of this array need not be confined to that as shown in FIG. 2, but it should be an array of baffles so arranged as to act as a radiant heat shield and higher temperature cryopumping surface while providing a path for lower boiling temperature gases to be admitted to the second stage pumping area.

The cryopump shown departs from conventional design in that it allows for entry of gases into the cryopump 20 through a second pumping port 56. This port is open to conduit 22 which conducts gases from the load lock 14 (FIG. 1). Gases from the load lock are thereby allowed to enter into a plenum 72 positioned between the radiation shield 50 and the base of the cryopump housing 44. Thus gas is admitted directly to the cryopump from the load lock after the roughing pump has eliminated most gases from the system.

The conduit 22 from the load lock to the cryopump is tightly sealed against the housing 44. Conduit mounting plate 74 is bolted down by screws 76 threaded into the housing 44. The mounting plate seals the conduit 22 tightly against the cryopump housing through use of O-ring 78. It is important not to allow leakage of ambient air into the cryopump at the conduit junction as this would eventually flood the cryopump, reducing operating vacuum and requiring early cryopump regeneration.

It should also be noted that contrary to past practice, a conduit 22 to the cryopump does not contact any cryogenic surfaces. By avoiding contact with cryogenic surfaces this configuration has no need for insulated connectors and cryogenic seals about the conduit.

The cryopump incorporating this invention is able to maintain the work chamber at its operating pressure while absorbing a pulse of gas from the load lock. The pulse of gas from the load lock is not allowed to travel through the cryopump to the work chamber. Radiation baffles 58 deflect heat radiation from direct passage through holes 46 into the second stage, pumping area. The second stage cooling area is thus shielded from direct transmittal of the heat radiation from the housing 44. This is done to prevent an excessive load on the coldest chevron array 54. Additionally, the air gap 51 between the radiation shield 50 and the cryopump housing 44 is extremely small (less than 1/16 of an inch) and thereby serves as a flow restriction which minimizes any chance of the work chamber being affected by the opening of the passage 22 between the load lock 14 and cryopump port 56. Alternatively, a positive, low conductivity seal may be placed between the radiation shield and the housing 44 to eliminate gas flow through the gap 51.

Most higher boiling temperature gases are pumped from the system within the plenum 72 by the baffles 58 and do not enter into the second stage pumping area. Those gases entering into the second stage pumping area are deflected by baffle 60 from transmission through the second stage pumping area to the work space. Lower condensing temperature gases condense on the second stage cryopanel 54 or are adsorbed by the adsorbent contained in the second stage cryopanel 54.

Conventional designs providing secondary pumping areas in cryopumps are designed to physically close the route from the secondary pumping port to the second stage pumping area. Special forms and shapes are introduced into the cryopump to prevent passage of gas from the second pumping port area into the primary porting area or vice versa. An aspect of this invention is that it has been discovered that it is not necessary to physically divide the two pumping areas of the cryopump. It is therefore much less expensive to incorporate this relatively simple baffle and spacing arrangement into the cryopump to define a second pumping area than to completely reconstruct a cryopump into multiple distinct pumping chambers which require seals at cryogenic temperatures.

A further advantage of the invention is that it allows for entry of low boiling point gases from the secondary pumping port to the second stage cryopanel so that they may be removed. Conventional designs do not attempt to remove these low boiling point gases.

Finally, since the two pumping areas of the cryopump are not physically separate, cryopump capacity is not affected by any possible mismatch of pump areas and gas volumes. Therefore, the entire pump is utilized by each port for gas condensation and storage. Because the amount of gas released by the load lock into the work chamber and removed by the cryopump in conventional systems is equivalent to the amount of gas directly cryopumped from the load lock by a system incorporating this invention, cryopump regeneration is not directly affected by the addition of a second port since the total amount of gas pumped remains the same. The addition of the second port may in fact result in more uniform condensation of the gases within the cryopump and thereby result in longer allowable work periods between cryopump regeneration.

Figure 3:
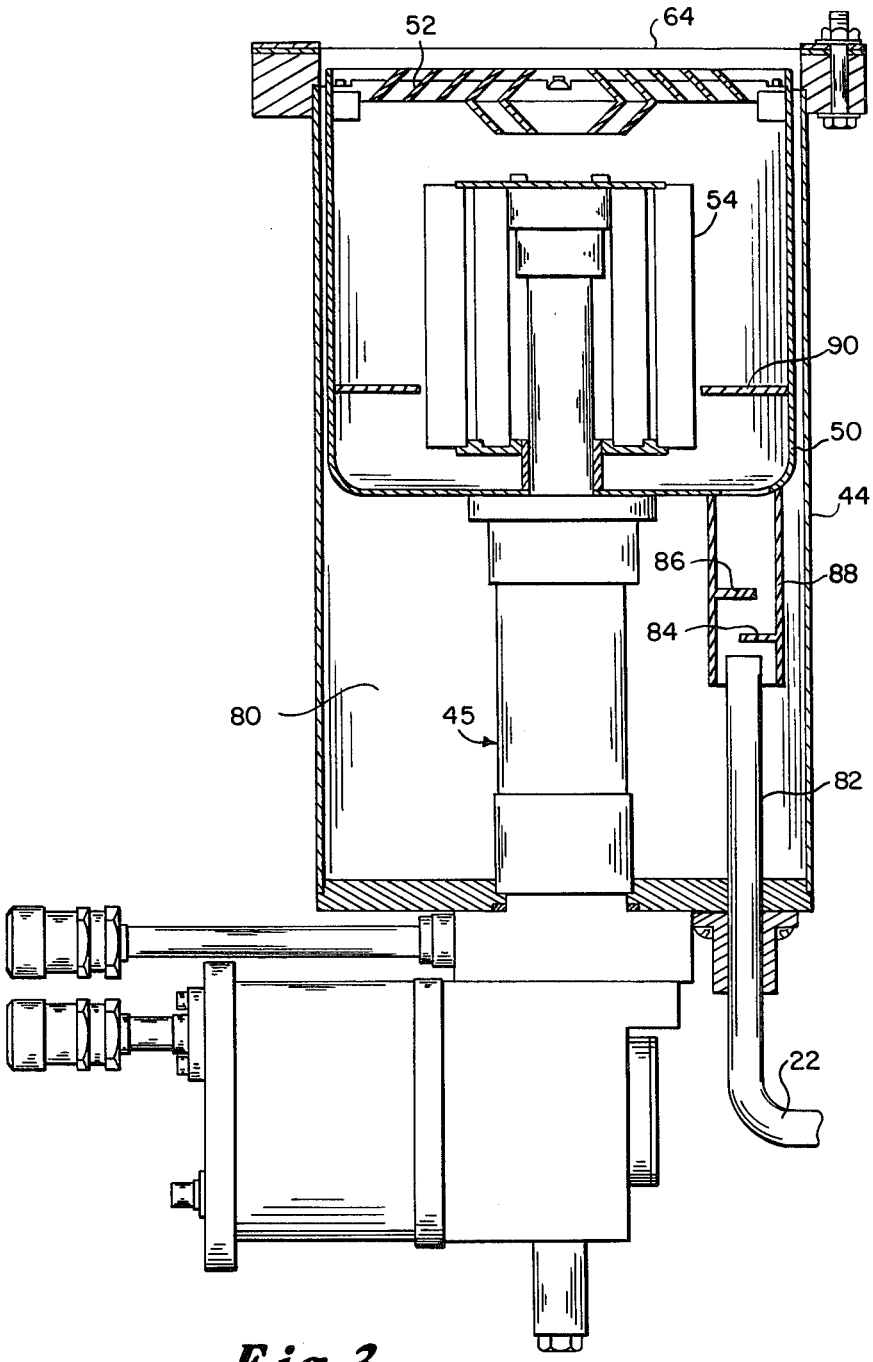
FIG. 3 is a cross section of an alternative embodiment of the invention.

An alternative embodiment of the invention is shown in FIG. 3. This embodiment reduces build-up of water vapor condensate at the rear of the radiation shield 50 adjacent to the plenum 80. This is required in certain situations for continuous very low vacuum operations.

Crossover gas from the load lock chamber passes through conduit extension 82 into the extension 88 of the radiation shield. Tube extension 82 and conduit 22 do not contact any cryogenic surfaces and therefore do not require insulated connectors or cryogenic seals.

The extension 88 from the radiation shield 50 directs the gas from the load lock towards the second stage pumping area. Higher temperature condensation point gases, such as water vapor, condense within the extension 88. This avoids an increase in emissivity of the radiation shield 50 that an ice build-up on its external surfaces would cause. Two baffles 84 and 86 serve to prevent direct radiation from reaching the second stage pumping area. Gases with higher temperature condensation points condense within the extension 88 and on the baffles 84, 86. The remaining lower temperature condensation point gases are blocked from transmission into the working chamber by baffles 90. These low temperature gases are condensed on the second stage cryopanel 54 or are adsorbed in the adsorbent maintained in the second stage cryopanel 54.

This embodiment is designed to prevent a rise in emissivity of the radiation shield. A rise in the emissivity would result in an increased transfer of heat radiation from the cryopump housing 44 to the radiation shield which would result in decreased cryopump efficiency.

Figure 4:
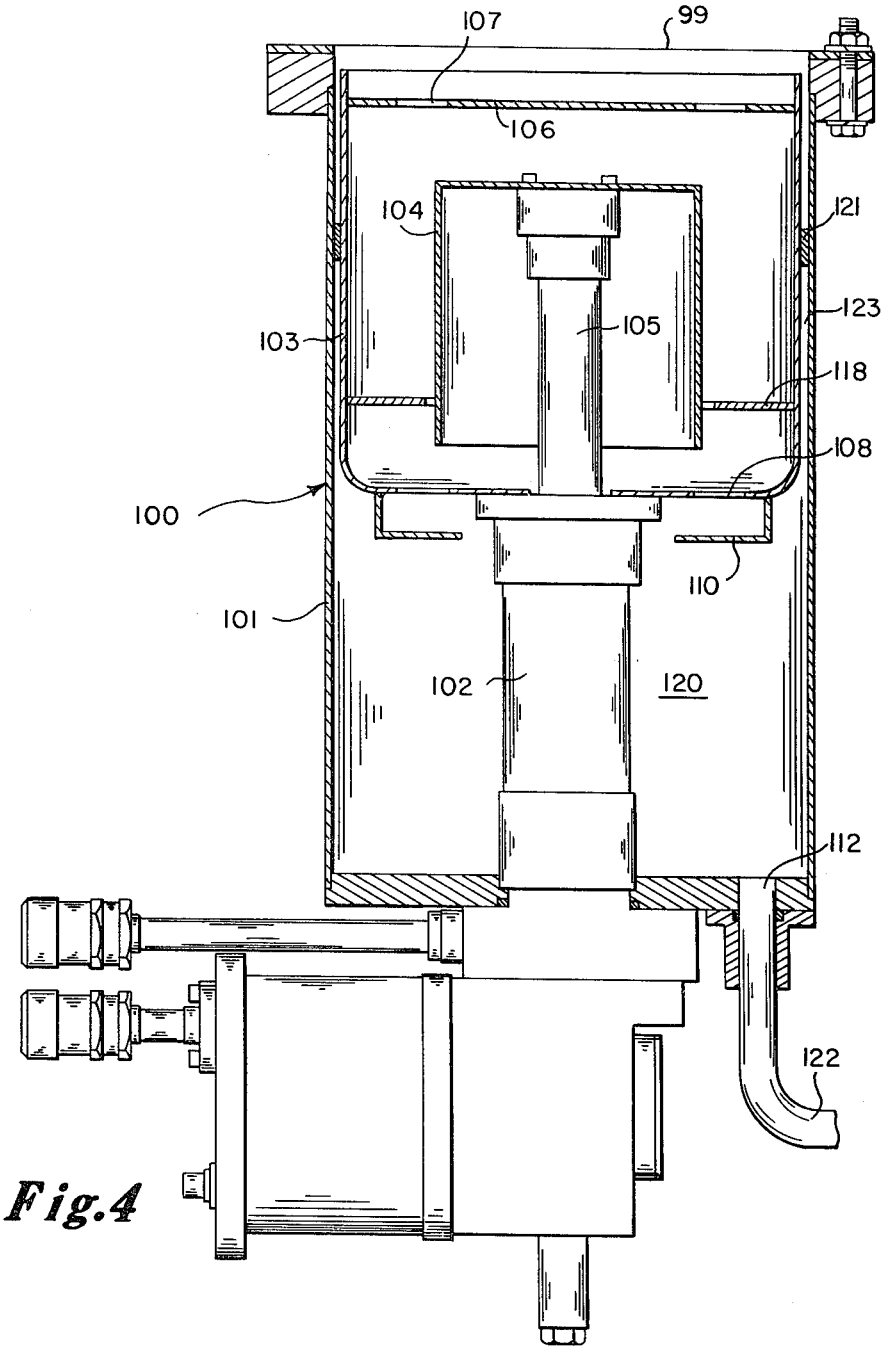
FIG. 4 is a cross section of an alternative cryopump incorporating the principles of this invention.

The principles of this invention may be incorporated into many different cryopump designs and applications. FIG. 4 is a cross section of a cryopump which is configured much the same as the cryopump described above in reference to FIG. 1.

The cryopump 100 of FIG. 4 is designed for moderate vacuum processes such as sputtering. The radiation shield 103 of the first stage refrigerator 102 has incorporated into it, at the work chamber port 99 a baffle plate 106. This baffle plate has a series holes 107 arranged on a radius which serve as orifices restricting the flow of inert and low boiling temperature gases to the second stage cryopanel 104. The baffle plate thereby aids in maintaining a low pressure inert gas environment in the work chamber. Higher condensing temperature gases such as water vapor condense on the baffle plate 106 itself. In order to minimize the effect of water build-up on plate 106 on the flow conductance of holes 107, the diameter of these holes should be in the range of 0.25 inch to 0.75 inch.

In this embodiment the second stage cryopanel 104 resembles an inverted cup which has adsorbent material adhering to its inner surfaces. Alternatively, the second stage cryopanel may be a chevron array as shown in FIGS. 2 and 3. The cryopanel 104 is thermally connected to the low temperature second stage refrigerator 105.

Differential pumping ports 108 serve the same purposes as discussed above with reference to FIGS. 2 and 3. Gas from the crossover chamber is fed from conduit 122 through housing port 112 into the cryopump. Higher temperature condensing gases are condensed in plenum 120 while baffles 110 prevent their transmission to the second stage pumping area.

Lower temperature condensing gases pass through differential port 108 and are condensed and adsorbed in the second stage. Baffles 118 prevent transmission of these gases to the work chamber.

Differential pumping ports 108 also serve to keep the greater part of the cryopump including plenum 120 at a vacuum pressure lower than that of the work chamber. This allows for maximum cryopump refrigerator efficiency by reducing the heat transferred by residual gas conduction from the room temperature cryopump housing 101 to the cold radiation shield 103. At the same time a moderate vacuum inert gas environment is maintained in the work chamber above baffle 106.

Air gap 123 between the radiation shield 103 and the cryopump housing 101 is extremely small and thereby serves to restrict fluid communication between ports 99 and 112. Alternatively, optional seal 121 may be added to further restrict fluid communication between the ports.

While the invention has been particularly shown and described with reference to preferred embodiments thereof, it will be understood by those in the art that various changes in form and details may be made without departing from the spirit and scope of the invention as defined by the appended claims. For example, the pumping port for the load lock may be located at different places on the cryopump housing 44. If properly arranged, the load lock port may still make use of the vacuum maintained in the interior of the cryopump to minimize transmission of gas from the load lock to the work chamber. Since the pump minimizes this transmission of gas, it provides for a continuously low pressure environment in the work chamber with less importation of impurities from the load lock.

We claim:

1. A cryopump system comprising:

a. a work chamber;

b. a load lock for receiving material to be introduced into the work chamber;

c. a cryopump housing in fluid communication with each of the work chamber and load lock;

d. a two stage refrigerator within the cryopump housing;

e. a second stage cryopumping surface in thermal contact with the second stage of the refrigerator; and f. a radiation shield in thermal contact with the first stage of the refrigerator within the cryopump housing surrounding the second stage cryopumping surface, the shield having a frontal opening for providing gas communication from the working chamber to the second stage cryopumping surface and a rear opening for providing gas communication from the load lock to the second stage cryopumping surface.

2. A cryopump system as claimed in claim 1 wherein the radiation shield is in close proximity to the cryopump housing to provide a flow restriction therebetween.

3. A cryopump system as claimed in claim 1 wherein the rear opening is covered by a baffle to block transmission of radiation to the second stage refrigerator.

4. A cryopump system as claimed in claim 1 wherein an extension from the radiation shield surrounds but does not contact a conduit from the load lock.

5. A cryopump system as claimed in claim 4 wherein the extension includes baffles therein for blocking radiation from the conduit and the load lock from impinging on the second stage cryopumping surface.

6. A cryopump system comprising:

a. a housing enclosing a first and second stage cryogenic refrigerator;

b. a first work chamber in fluid communication with both stages of said refrigerator through a first port in the housing;

c. a second chamber in fluid communication with both stages of said refrigerator through a second port in the housing;

d. a frontal cryopanel extending across said first port and in thermal communication with a first stage of said refrigerator; and e. baffle means between said second port and the second stage of said refrigerator and in thermal communication with said first stage of said refrigerator for preventing direct transfer of heat radiation between said second port and said second stage refrigerator.

7. A cryopump comprising:

a. a cryopump housing, said housing having a first port for attachment to a first work chamber;

b. a refrigerator within said housing having first and second stages;

c. a second stage cryopanel mounted to a low temperature heat sink on the second stage;

d. a radiation shield partially enclosing said second stage cryopanel, coaxial with the refrigerator and in thermal contact with an intermediate temperature heat sink on the first stage;

e. a frontal cryopanel extending across a first opening in the radiation shield adjacent said first port to said work chamber, the frontal cryopanel being in thermal contact with the first stage of the refrigerator;

f. a second port in the cryopump housing, said second port removed from said work chamber and in fluid communication with a second chamber;

g. a second opening in the radiation shield in fluid communication with said second port in the refrigerator housing.

8. A cryopump as claimed in claim 7 further comprising baffle means adjacent to said second opening for deflection of gases from direct communication with said second stage cryopanel.

9. A cryopump as recited in claim 7 wherein said second opening in the radiation shield maintains low pressure in the area of the cryopump removed from said first port in order to reduce heat load on the refrigerator.

10. A cryopump as recited in claim 7 further comprising seal means positioned between the cryopump housing the radiation shield in order to further restrict fluid communication between said first and second ports.

11. A method of continuously processing material in a high vacuum chamber comprising the steps of:

a. reducing work chamber pressure to a system operating pressure by means of a work chamber cryopump;

b. introducing material into a load lock;

c. reducing the load lock pressure to an intermediate pressure by means of a roughing pump;

d. isolating the load lock from said roughing pump;

e. reducing said load lock intermediate pressure to about work chamber pressure by means of the work chamber cryopump;

f. connecting said work chamber to said load lock; and g. transferring said material from the load lock to the work chamber.

* * * * *